US009567854B2

(12) United States Patent
Nelson

(10) Patent No.: US 9,567,854 B2
(45) Date of Patent: Feb. 14, 2017

(54) ROCK BOLTER WITH ALIGNMENT MECHANISM FOR SWINGING BETWEEN DRILLING AND BOLTING

(71) Applicant: Yves Nelson, Algoma Mills (CA)

(72) Inventor: Yves Nelson, Algoma Mills (CA)

(73) Assignee: 1311854 Ontario Limited, Ontario (CA)

( * ) Notice: Subject to any disclaimer, the term of this patent is extended or adjusted under 35 U.S.C. 154(b) by 408 days.

(21) Appl. No.: 14/255,669

(22) Filed: Apr. 17, 2014

(65) Prior Publication Data

US 2015/0300170 A1 Oct. 22, 2015

(51) Int. Cl.
*E21D 21/00* (2006.01)
*E21D 20/02* (2006.01)
*E21D 20/00* (2006.01)

(52) U.S. Cl.
CPC ..... *E21D 20/003* (2013.01)

(58) Field of Classification Search
CPC ..... E21D 20/028; E21D 2021/006; E21D 20/025; E21D 20/02; E21D 20/021
USPC ..... 405/259.1, 259.2, 259.3, 259.4, 259.6, 405/262
See application file for complete search history.

(56) References Cited

U.S. PATENT DOCUMENTS 2,673,452 A * 3/1954 Glaze ..... E21D 20/003 173/152
2,741,461 A * 4/1956 Joy ..... E21D 20/003 173/150
3,973,409 A * 8/1976 Asayama ..... E21D 20/003 175/292
4,226,559 A * 10/1980 Prebensen ..... E21B 7/025 173/184
4,274,762 A * 6/1981 Johnson ..... E21D 20/00 405/259.1
4,313,628 A * 2/1982 Duenke ..... F16L 31/00 285/115
4,344,599 A * 8/1982 Herron ..... E21B 3/04 173/28
4,351,625 A * 9/1982 Selestam ..... E21D 20/003 173/184
4,398,850 A * 8/1983 Talvensaari ..... E21D 20/006 173/193
4,588,037 A * 5/1986 Combet ..... E21D 20/003 173/192

(Continued)

OTHER PUBLICATIONS

Office Action dated May 6, 2015; issued by Canadian Patent Office for related Canadian Application No. 2,849,179.

(Continued)

*Primary Examiner* — Benjamin Fiorello
*Assistant Examiner* — Edwin Toledo-Duran
(74) *Attorney, Agent, or Firm* — Allen J. Moss; Squire Patton Boggs (US) LLP

(57) ABSTRACT

A rock drilling and bolting system includes a frame, a drill feed rail rotationally supported on the frame, the drill feed rail having a drill feed slidable on the drill feed rail and a bolter feed rail rotationally supported on the frame, the bolter feed rail having a bolter feed slidable on the bolter feed rail. The system further includes a rotary mechanism comprising a first pivot arm and a parallel second pivot arm that rotationally couples the bolter feed rail to the drill feed rail and an actuator mounted to the frame and the rotary mechanism for simultaneously rotating the drill feed rail and the bolter feed rail between a drilling position for drilling and a bolting position for bolting.

15 Claims, 17 Drawing Sheets

(56) References Cited

U.S. PATENT DOCUMENTS

| | | | | |
|---|---|---|---|---|
| 4,708,533 | A * | 11/1987 | Leppanen | E21D 20/028 137/355.12 |
| 4,732,509 | A * | 3/1988 | Leppanen | E21D 20/028 405/259.5 |
| 5,114,279 | A * | 5/1992 | Bjerngren | E21D 20/006 405/259.1 |
| 5,165,825 | A * | 11/1992 | Wallin | E21D 20/003 405/259.6 |
| 6,447,210 | B1 * | 9/2002 | Coombs | E21D 20/025 405/259.5 |
| 6,698,529 | B2 | 3/2004 | Coombs et al. | |
| 7,407,344 | B2 * | 8/2008 | Hinshaw | E21D 20/006 175/52 |
| 7,416,033 | B2 * | 8/2008 | Hinshaw | E21D 20/003 175/122 |
| 7,607,866 | B2 * | 10/2009 | Eddowes | E21B 19/086 211/70 |
| 2002/0119014 | A1 * | 8/2002 | Coombs | E21D 20/025 405/269 |
| 2003/0066665 | A1 * | 4/2003 | Coombs | E21D 20/006 173/32 |
| 2007/0031196 | A1 * | 2/2007 | Bruneau | E21D 21/0026 405/259.4 |
| 2012/0163924 | A1 * | 6/2012 | Rataj | E21D 21/008 405/259.3 |
| 2014/0112724 | A1 * | 4/2014 | Nelson | E21D 20/00 405/259.1 |

OTHER PUBLICATIONS

Office Action dated Aug. 7, 2015; issued by Canadian Patent Office for related Canadian Application No. 2,849,179.

* cited by examiner

ROCK BOLTER WITH ALIGNMENT MECHANISM FOR SWINGING BETWEEN DRILLING AND BOLTING

TECHNICAL FIELD

The present invention relates generally to mining equipment and, in particular, to rock drilling and rock bolting.

BACKGROUND

In a mine, ground support, e.g. rock bolts and screening, is used to prevent rock falls. Several different types of rock bolts may be used but all require that holes be drilled in the rock first. This is done with equipment known as rock bolters. These are mobile units with a bolting head attached. To drill a hole in the rock to install ground support, the bolting head is placed against the rock face (which is called "stinging the face") and then a hole is drilled into the rock. The unit is then indexed to install the rock bolt as ground support.

Conventionally, the step of indexing from the drill to the bolter is problematic since it may result in misalignment of the bolter relative to the drilled hole. Conventionally, the drill feed must be retracted (by moving a feed extension cylinder or boom) to remove the drill feed from the rough uneven rock face before indexing. Ground support operations can become inefficient, time-consuming and expensive when misalignment occurs. A need therefore exists for an effective solution to this technical problem.

SUMMARY

In broad terms, the present invention provides a novel system and method for synchronously rotating the drill feed and bolter feed from a drilling position to a bolting position. This system and method enable the bolter feed to be more precisely aligned with the hole drilled by the drill feed.

Accordingly, one inventive aspect of the present disclosure is a rock drilling and bolting system. This system includes a drill feed rail having first and second pivot attachment points and a bolter feed rail having first and second pivot attachment points, the bolter feed rail being parallel to the drill feed rail. The system includes a drill feed adapted to slide on the drill feed rail and a bolter feed adapted to slide on the bolter feed rail. The system further includes a first L-shaped pivot arm pivotally connected to the first pivot attachment points of the drill feed rail and the bolter feed rail. The system further includes a second L-shaped pivot arm pivotally connected to the second pivot attachment points of the drill feed rail and the bolter feed rail. The system has a frame and an actuator mounted to the frame for rotating the drill feed rail and the bolter feed rail. The bolter feed rail is rotationally coupled to the drill feed rail by the first and second pivot L-shaped pivot arms to enable the drill feed rail and the bolter feed rail to rotate in unison between a drilling position and a bolting position.

Another inventive aspect of the present disclosure is a method of installing ground support using a rock drilling and bolting system having a drill feed rail and a bolter feed rail. The method entails positioning a drill feed rail being pivotally connected at two attachment points to a bolter feed rail by first and second L-shaped pivot arms, feeding a drill string using a drill feed slidable on the drill feed rail and drilling a hole in the rock. The method then entails rotating the drill feed rail and the bolter feed rail using an actuator mounted to a frame to rotate the drill feed rail out of alignment with the hole and to concurrently rotate the bolter feed rail into alignment with the hole, feeding a rock bolt using a bolter feed slidable on the bolter feed rail and installing the rock bolt into the hole.

Yet another inventive aspect of the present disclosure is a rock drilling and bolting system having a frame, a drill feed rail mounted to the frame and a bolter feed rail mounted to the frame in a back-to-back arrangement with the drill feed rail. The system has a drill feed movably mounted on the drill feed rail and a bolter feed movably mounted on the bolter feed rail. The system also has a first pivot arm pivotally connected to the frame and a second pivot arm pivotally connected to the frame. The system has an actuator connected between the first and second pivot arms for rotating the drill feed rail and bolter feed rail from a drilling position to a bolting position that is aligned with a hole drilled in the drilling position.

Yet another inventive aspect of the present disclosure is method of installing ground support using a rock drilling and bolting system. The method includes positioning a drill feed rail at a rock face, the drill feed rail being attached via a frame in a back-to-back arrangement to a bolter feed rail, feeding a drill string using a drill feed movably mounted to the drill feed rail, and drilling a hole in the rock face. The method further includes rotating the frame, drill feed rail and bolter feed rail using an actuator connected to first and second L-shaped pivot arms which are also pivotally connected to the frame to thereby rotate the bolter feed rail into alignment with the hole, feeding a rock bolt using a bolter feed movably mounted to the bolter feed rail, and installing the rock bolt into the hole.

Yet another inventive aspect of the present disclosure is a rock drilling and bolting system that includes a frame, a drill feed rail rotationally supported on the frame, the drill feed rail having a drill feed slidable on the drill feed rail and a bolter feed rail rotationally supported on the frame, the bolter feed rail having a bolter feed slidable on the bolter feed rail. The system further includes a rotary mechanism comprising a first pivot arm and a parallel second pivot arm that rotationally couples the bolter feed rail to the drill feed rail and an actuator mounted to the frame and the rotary mechanism for simultaneously rotating the drill feed rail and the bolter feed rail between a drilling position for drilling and a bolting position for bolting.

Yet another inventive aspect of the present disclosure is a rock drilling and bolting system that has a boom, a frame mounted to the boom, a drill feed rail, a bolter feed rail mounted to the drill feed rail and rotatable with the drill feed rail and a rotary actuator mounted between the frame and one or both of the drill feed rail and the bolter feed rail, wherein rotation of the rotary actuator indexes the drill feed rail and the bolter feed rail.

This summary is provided to highlight certain significant inventive aspects but is not intended to be an exhaustive or limiting definition of all inventive aspects of the disclosure. Other inventive aspects may be disclosed in the detailed description and drawings.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals. It should furthermore be noted that the drawings are not necessarily to scale.

DETAILED DESCRIPTION

Figure 1:
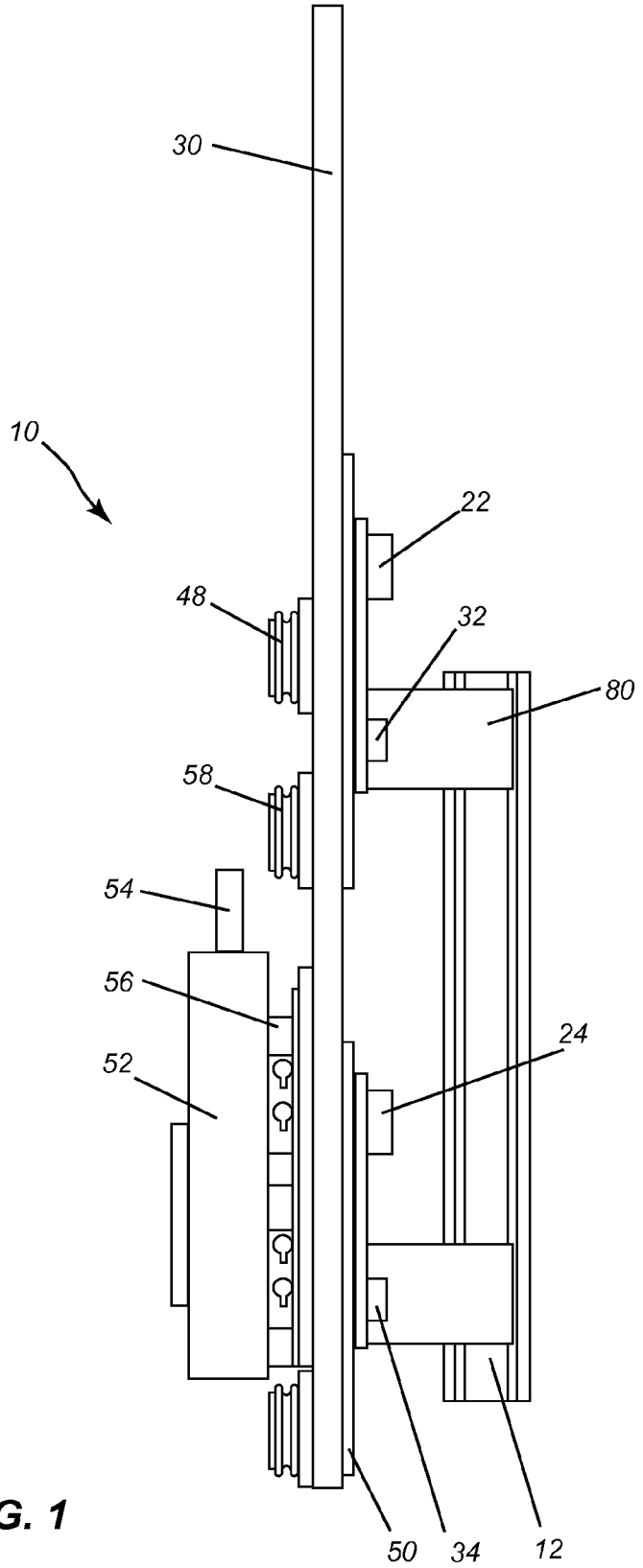
FIG. 1 is a side view of a rotary mechanism for concurrently rotating a drill feed rail and a bolter feed rail in accordance with a first embodiment of the present invention.

By way of introduction, the present invention provides a novel drilling and bolting system that includes a rotary mechanism for concurrently rotating a drill feed rail and a bolter feed rail from a drilling position to a bolter position and then back to the drilling position.

A system 10 in accordance with a first embodiment of the present invention is depicted in FIGS. 1-6. A second embodiment is depicted in FIGS. 7-14.

As depicted in the first embodiment of FIGS. 1-6, the rock drilling and bolting system 10 includes a frame 12 which may be mounted or otherwise secured to the rock bolter or which may be an existing part of the rock bolter. As depicted in FIGS. 1-6, the system 10 includes a drill feed rail 20 having first and second pivot attachment points 22, 24. The system also includes a bolter feed rail 30 having first and second pivot attachment points 32, 34. The bolter feed rail is parallel to the drill feed rail 20. Note that the bolter feed rail always remains parallel to the drill feed rail throughout its full range of motion.

The drill feed rail supports a movable (i.e. slidable) drill feed on a drill feed carriage 40. The bolter feed rail supports a movable (i.e. slidable) bolter feed on a bolter feed carriage 50. In the right side view of FIG. 1, the bolter feed 52 is visible but the drill feed is not visible. The bolter feed 52 has a socket or holder 54 for receiving a rear end of the rock bolt and thus to drive the rock bolt forward when the bolter feed advances. The bolter feed 52 is mounted to the carriage 50 via a support member 56.

As further depicted in FIGS. 1-6, the system includes a drill feed for feeding a drill string by sliding over the drill feed rail. The system includes a bolter feed for feeding a rock bolt by sliding over the bolter feed rail.

The system 10 includes a first L-shaped pivot arm 60 pivotally connected to the first pivot attachment points of the drill feed rail 20 and the bolter feed rail 30.

The system 10 also includes a second L-shaped pivot arm 70 pivotally connected to the second pivot attachment points of the drill feed rail and the bolter feed rail.

The first and second L-shaped pivot arms 60, 70 are symmetrical elbow-like members having two orthogonal sub-arms of equal length. The distance between points 22, 32 is less than the distance between points 22, 24.

The system 10 includes an actuator 80 for rotating the drill feed rail 20 and the bolter feed rail 30. The actuator 80 is mounted to the frame 12 and the first L-shaped pivot arm 70.

The bolter feed rail 30 is rotationally coupled to the drill feed rail 20 by the first and second pivot L-shaped pivot arms to enable the drill feed rail 20 and the bolter feed rail 30 to rotate in unison between a drilling position in which the drill feed rail 20 is aligned with a drilled hole H and a bolting position in which the bolter feed rail 30 is aligned with the drilled hole H.

In FIG. 1, the actuator 80 is a hydraulic rotary actuator. In another embodiment, the actuator may be a hydraulic linear actuator (i.e. a hydraulic cylinder).

For the purposes of this specification, the actuator and pivot arms constitute a rotary mechanism for synchronously rotating the drill and bolter feed rails.

The system disclosed herein may be faster to operate than prior-art systems as it requires only a single motion versus three motions (retract, index, extend) for conventional systems. The mechanism is also less complicated than in conventional systems.

Figure 2:
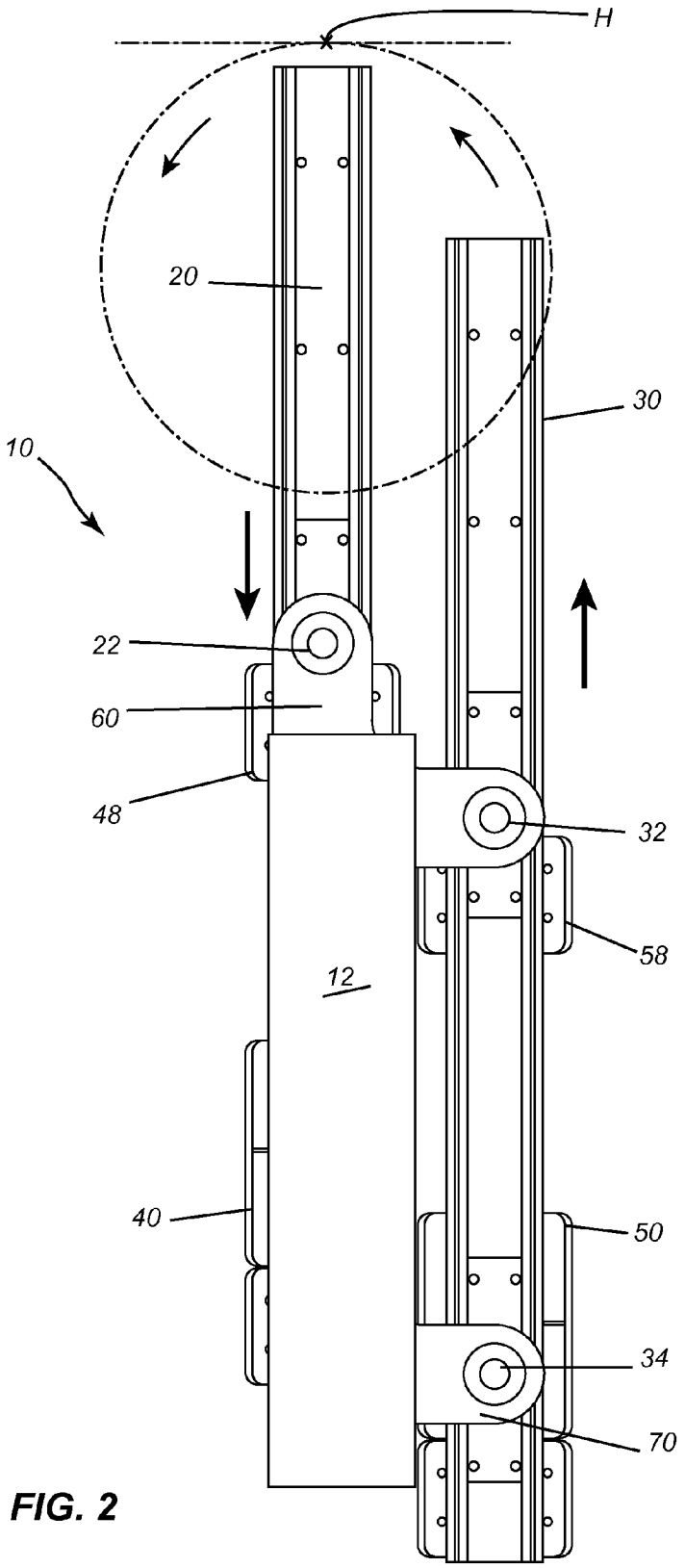
FIG. 2 is a bottom view of the rotary mechanism with the drill feed rail fully extended.
Figure 3:
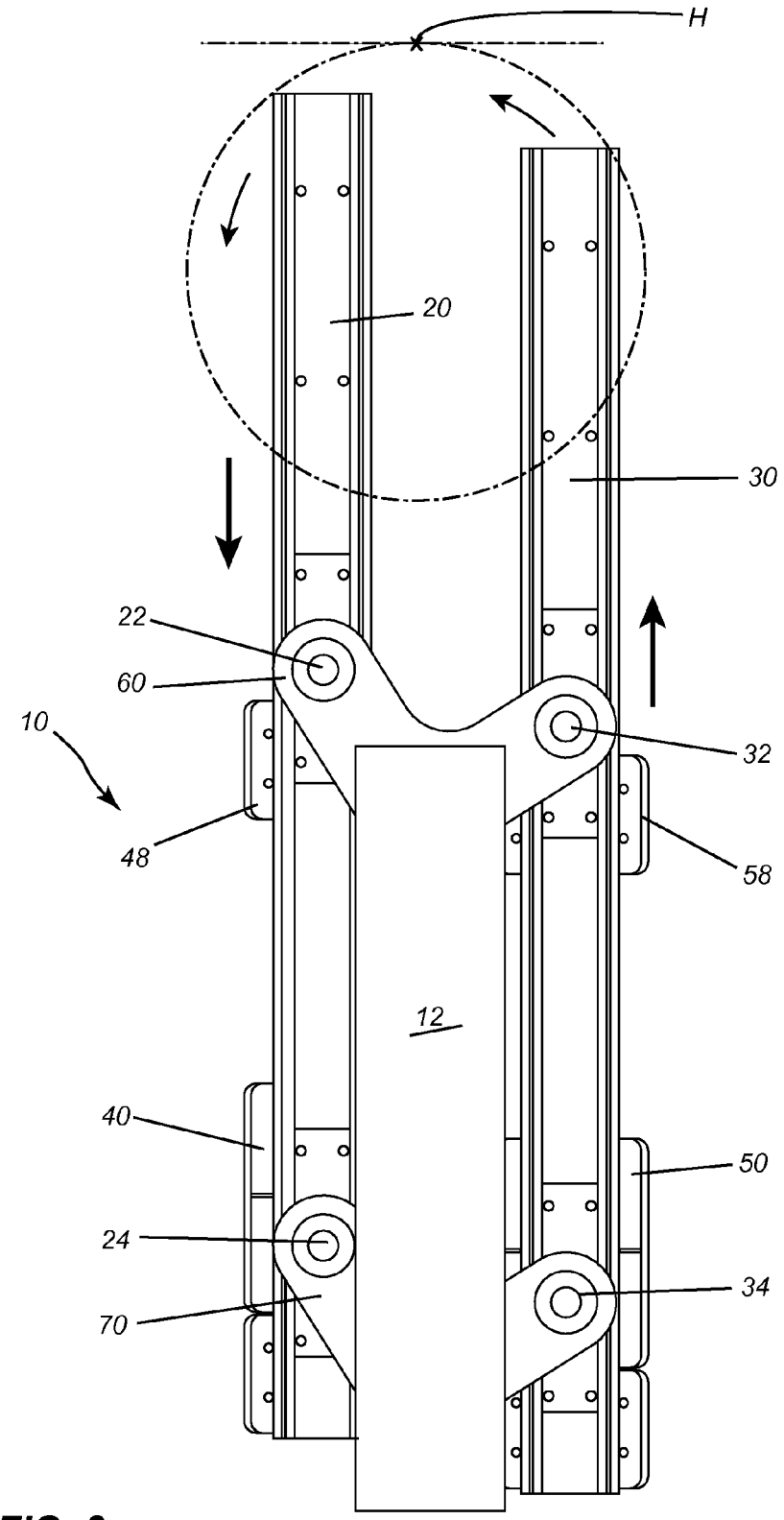
FIG. 3 is a bottom view of the rotary mechanism as rotation begins to swing the drill feed rail out of alignment and the bolter feed rail into alignment.
Figure 4:
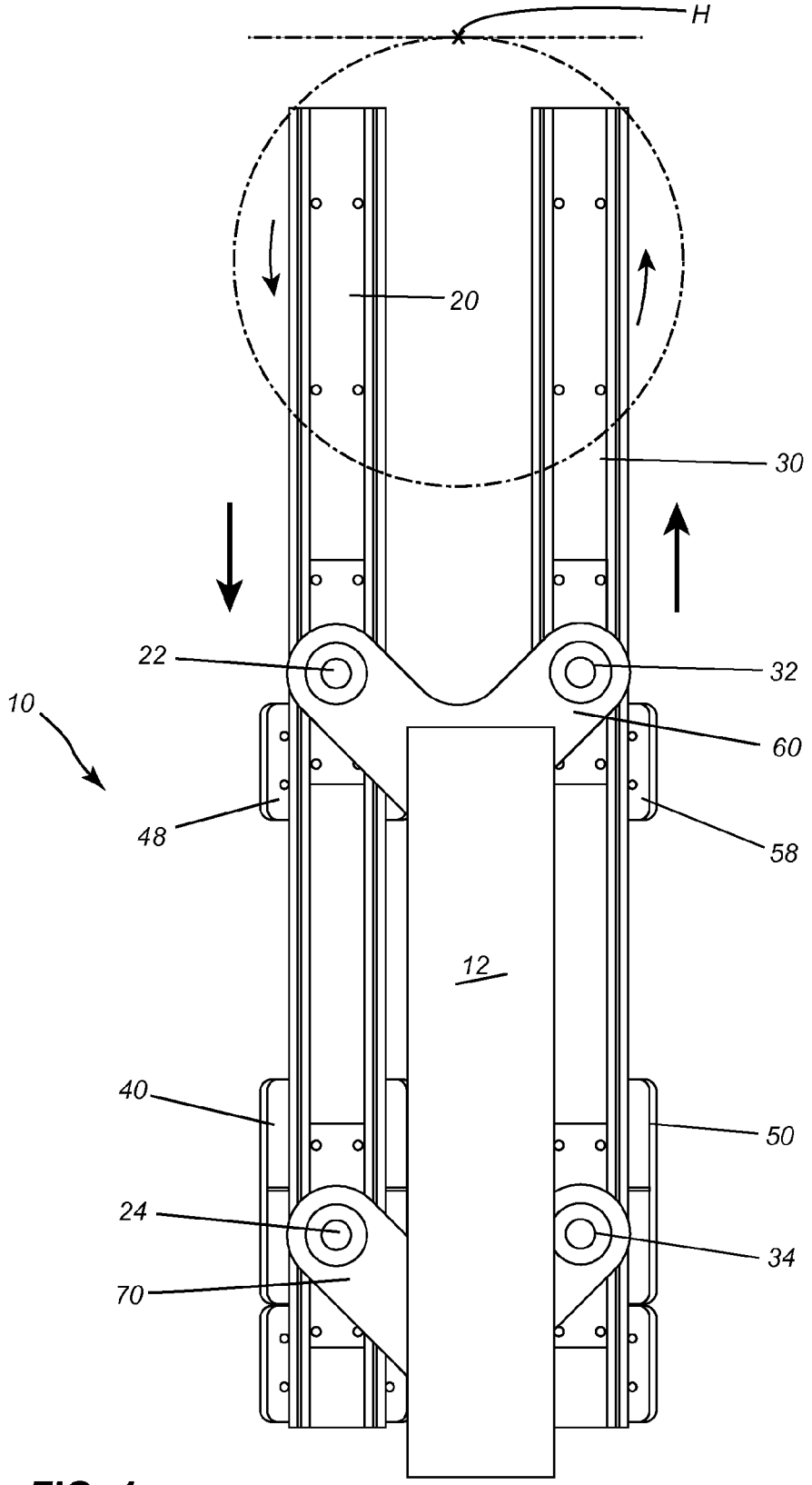
FIG. 4 is a bottom view of the rotary mechanism in an intermediate posture with the drill feed rail swinging back and the bolter feed rail swinging forward.
Figure 5:
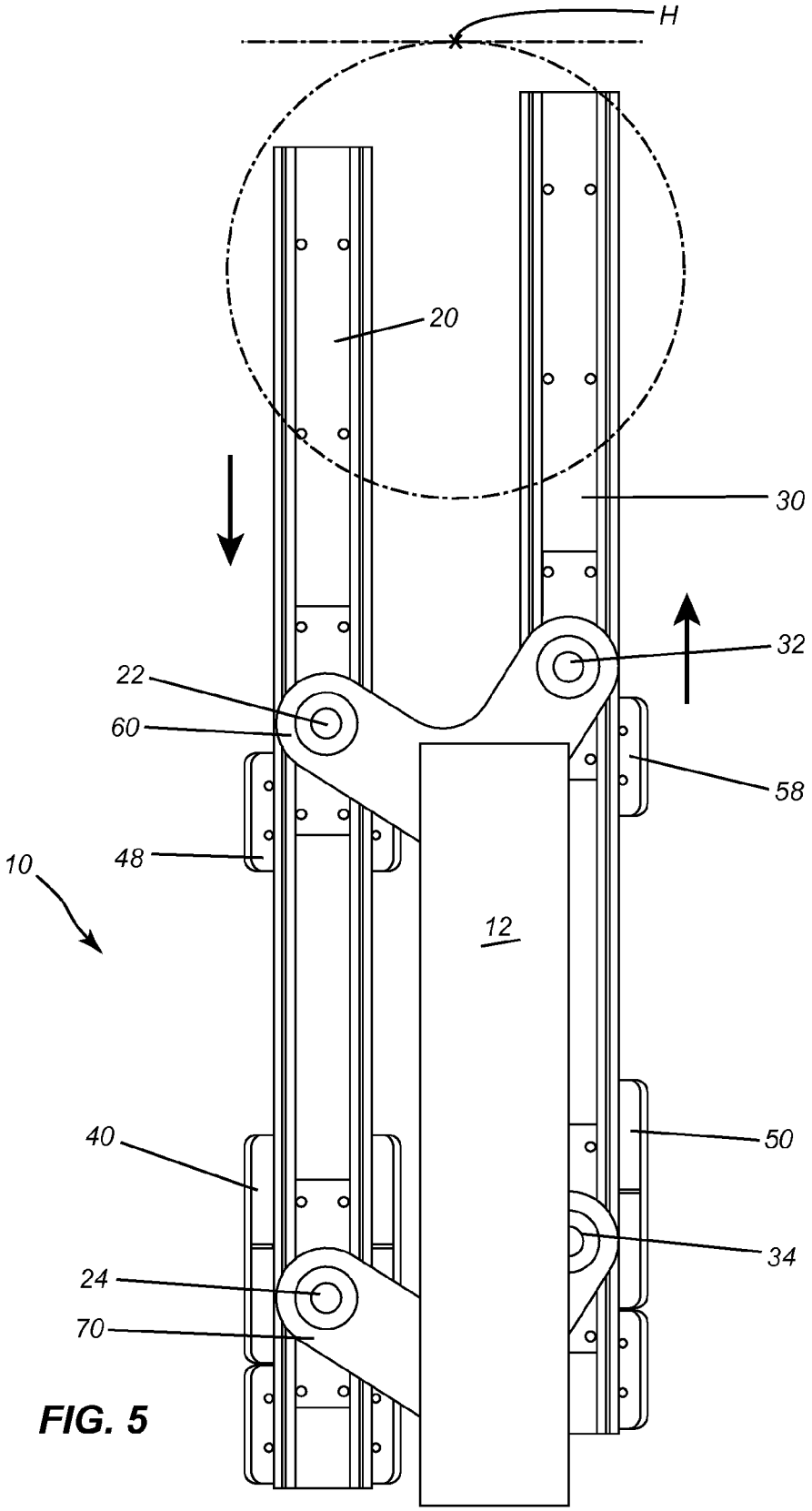
FIG. 5 is a bottom view of the rotary mechanism with the bolter feed rail rotating toward the rock face.
Figure 6:
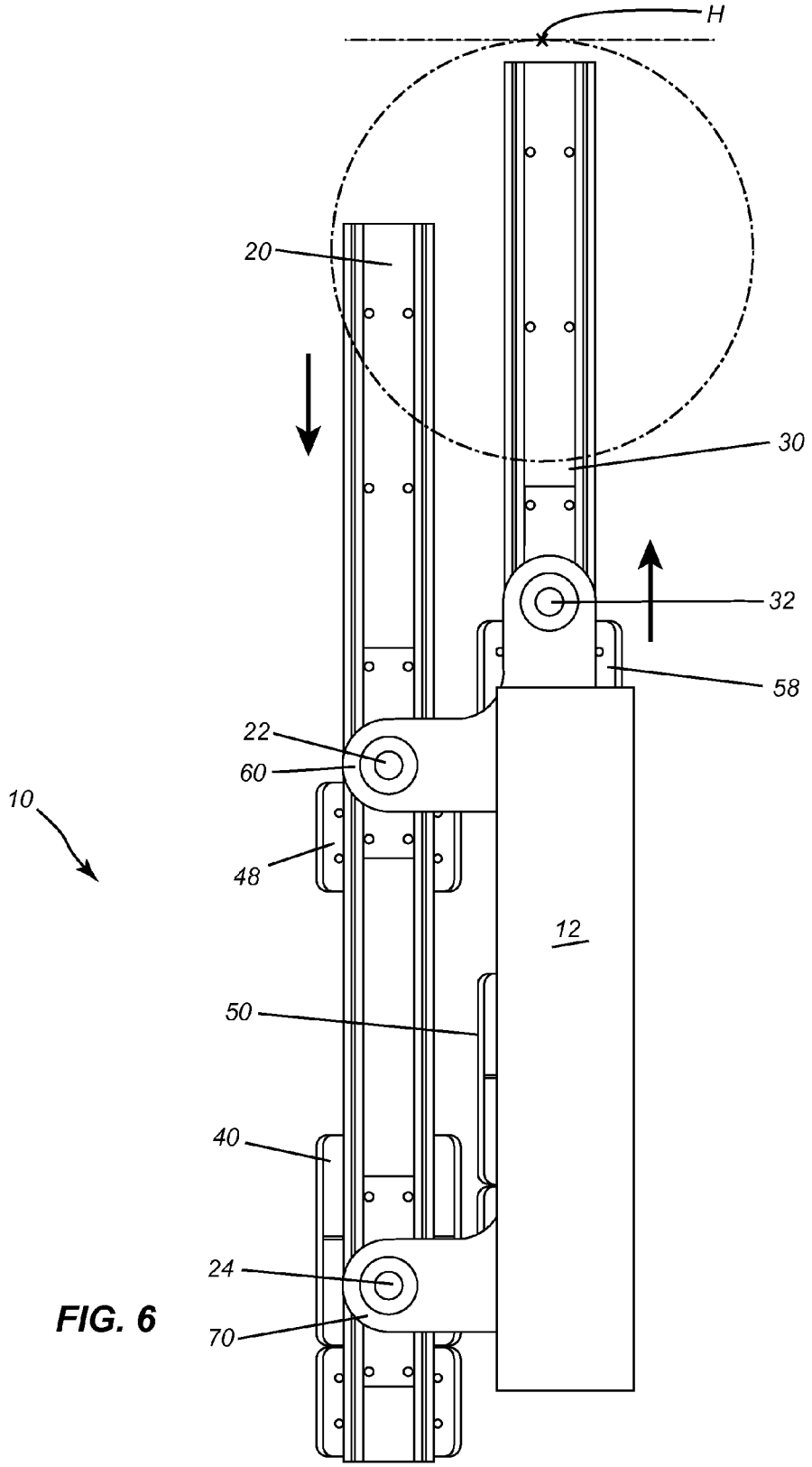
FIG. 6 is a bottom view of the rotary mechanism with the bolter feed rail fully extended and aligned with the drilled hole in the rock face.
Figure 7:
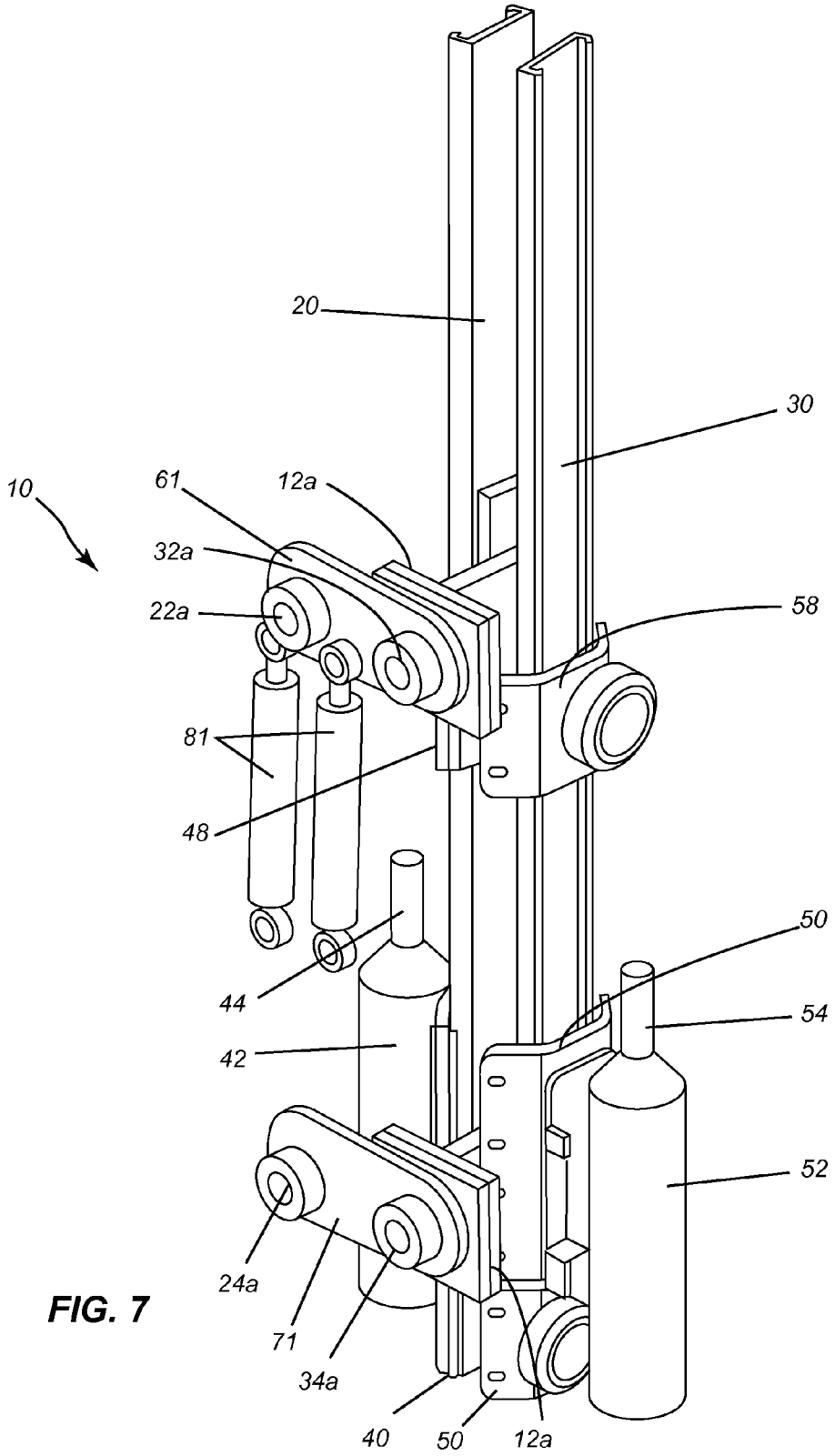
FIG. 7 is an isometric view of a rotary mechanism for a system having back-to-back feed rails in accordance with a second embodiment of the present invention.

FIGS. 2-6 incrementally depict the rotation of the drill and bolter feed rails. In FIG. 2, the drill feed rail is shown fully extended. This is the drilling position. In this position, the drill string may be advanced using the drill feed to drill a hole H in the rock face in order to install ground support into the rock. After drilling the hole H is complete, the drill feed is retracted. Instead of retracting the drill feed rail, it is rotated (swung) in unison with the bolter feed rail to move the drill feed rail out of alignment with the hole H and to concurrently move the bolter feed rail into alignment with the hole H. FIG. 3 shows the drill feed rail rotating further out of alignment with the hole H and the bolter feed rail rotating toward the hole H. FIG. 4 is shows an intermediate posture with the drill feed rail swinging back and the bolter feed rail swinging forward. This is a neutral position. In the neutral position, the hole H may be filled with cement or other such material as a prelude to inserting the rock bolt into the hole. FIG. 5 shows the bolter feed rail rotating closer toward the hole in the rock face. FIG. 6 shows the bolter feed rail fully extended and aligned with the drilled hole H in the rock face. Note that the pivot arms in this particular embodiment have rotated substantially 90 degrees from the drilling position to the bolting position. At this point, the rock bolt is inserted into the hole H.

To return to the drilling position, the rotary mechanism rotates in the opposite direction to move from the bolting position back to the drilling position. The sequence of drilling and bolting operations thus involves the rotary mechanism swinging back and forth between drilling and bolting positions.

In a second embodiment, which is depicted in FIGS. 7-14, the rock drilling and bolting system 10 includes a frame 12 having a back-to-back mounting bracket 12*a* for mounting a drill feed rail 20 and a bolter feed rail 30 to the frame 12 in a back-to-back arrangement. Note that in the first embodiment the feed rails are side-by-side whereas in the second embodiment the feed rails are back-to-back. A drill feed 42 is movably mounted on the drill feed rail 20. A bolter feed 52 is movably mounted on the bolter feed rail 30. The drill feed 42 has a socket or holder 44 for holding a rear end of a drill string. Likewise, the bolter feed 52 has a socket or holder 54 for holding a rear end of a rock bolt. The drill feed 42 comprises a main carriage 40 and a forward carriage 48 adapted to slide over the drill feed rail 20. Likewise, the bolter feed comprises a main carriage 50 and a forward carriage 58 adapted to slide over the bolter feed rail 30.

As depicted in FIGS. 7-14, a first pivot arm 61 is pivotally connected to the frame 12 at pivot attachment point 22*a* and is also pivotally connected to the bracket 12*a* at pivot attachment point 32*a*. Likewise, a second pivot arm 71 is pivotally connected to the frame 12 at pivot attachment point 24*a* and is also pivotally connected to the bracket 12*a* at pivot attachment point 34*a*. Note that in the second embodiment the pivot arms 61, 71 are straight members of equal length, not L-shaped or elbow-shaped as in the first embodiment. The length of the pivot arms is less than the length of the frame 12, i.e. shorter than the distance between the pivot attachments points 32*a*, 34*a*. An actuator (or a pair of actuators 81 as depicted by way of example in FIG. 7) is connected between the first and second pivot arms 61, 71 for rotating the drill feed rail 20 and the bolter feed rail 30 in unison, i.e. synchronously or currently. The system 10 thus moves from a drilling position to a bolting position. In the bolting position, the bolt supported by the bolter feed is aligned with the hole that was drilled in the rock face while in the drilling position. As noted above, the actuator may be linear hydraulic actuator or a pair of linear hydraulic actuators 81 as shown. Alternatively, another type of actuator may be used (e.g. a rotary actuator). In the second embodiment, the rotary mechanism includes the pivot arms 61, 71 and the actuators 81.

Figure 8:
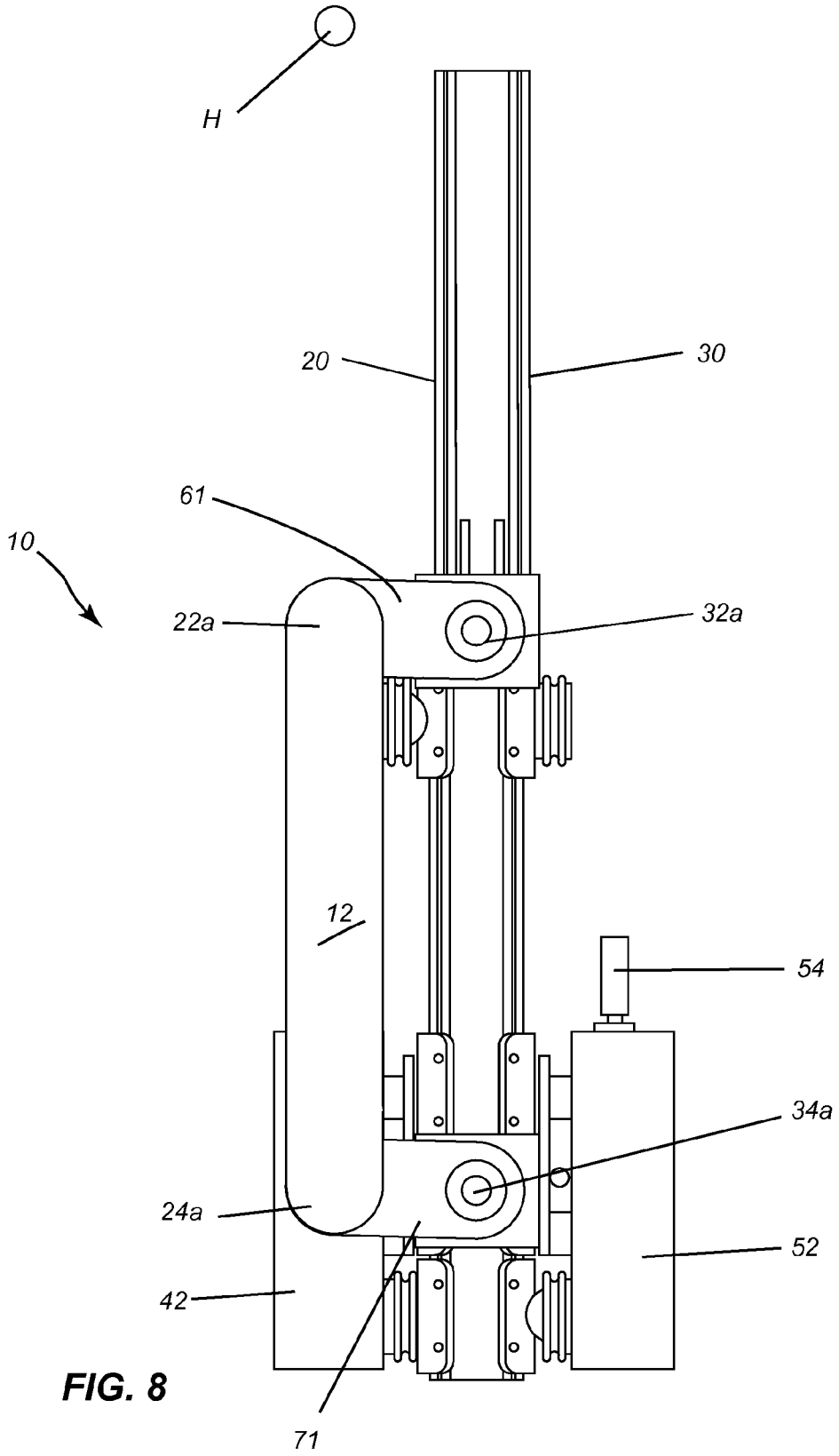
FIG. 8 is a bottom view of the rotary mechanism of FIG. 7 in an initial posture with the drill feed rail fully extended to the rock face.
Figure 9:
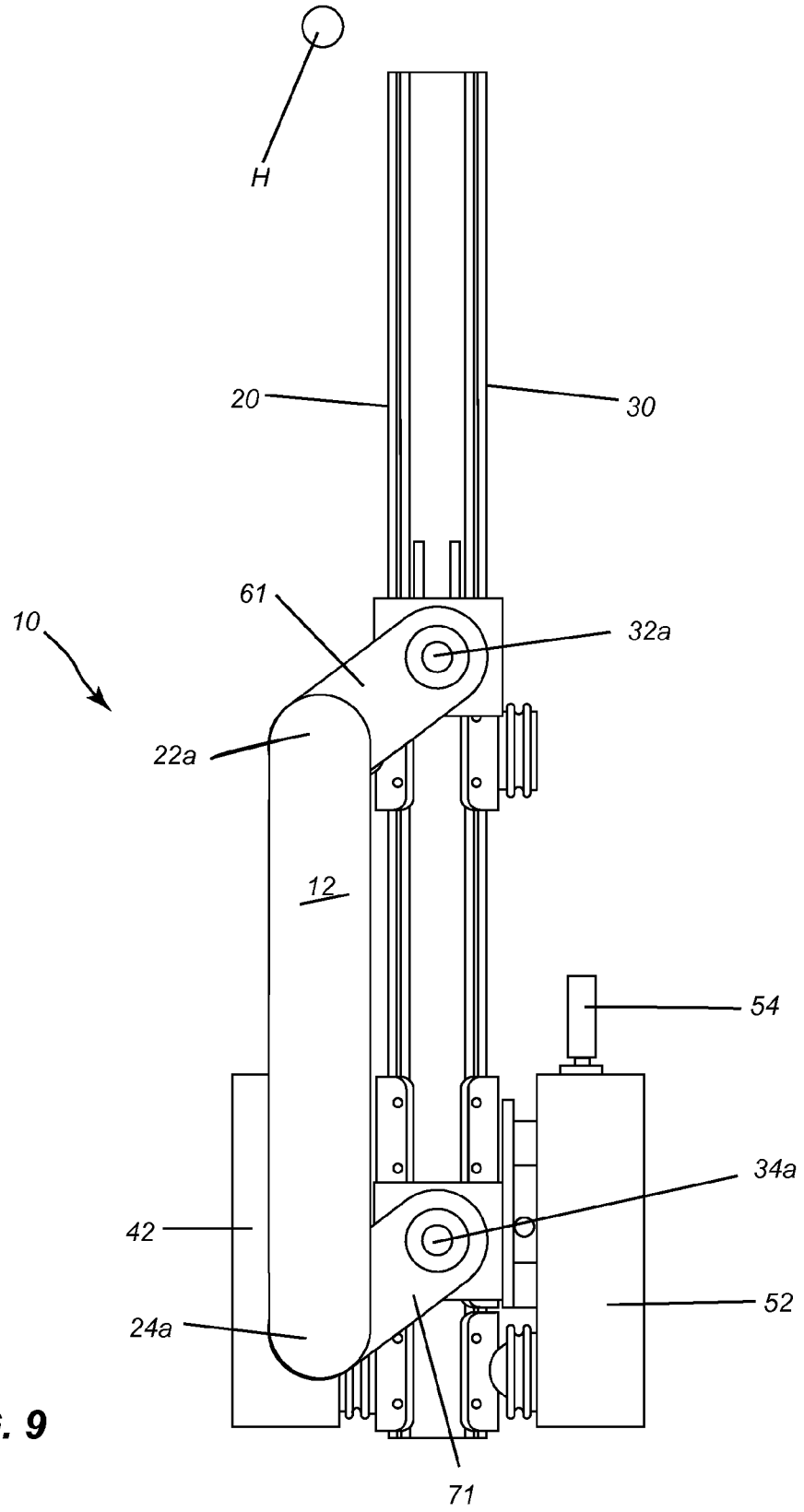
FIG. 9 is a bottom view of the rotary mechanism of FIG. 7 as the drill feed rail swings from the drilling position to the bolting position.
Figure 10:
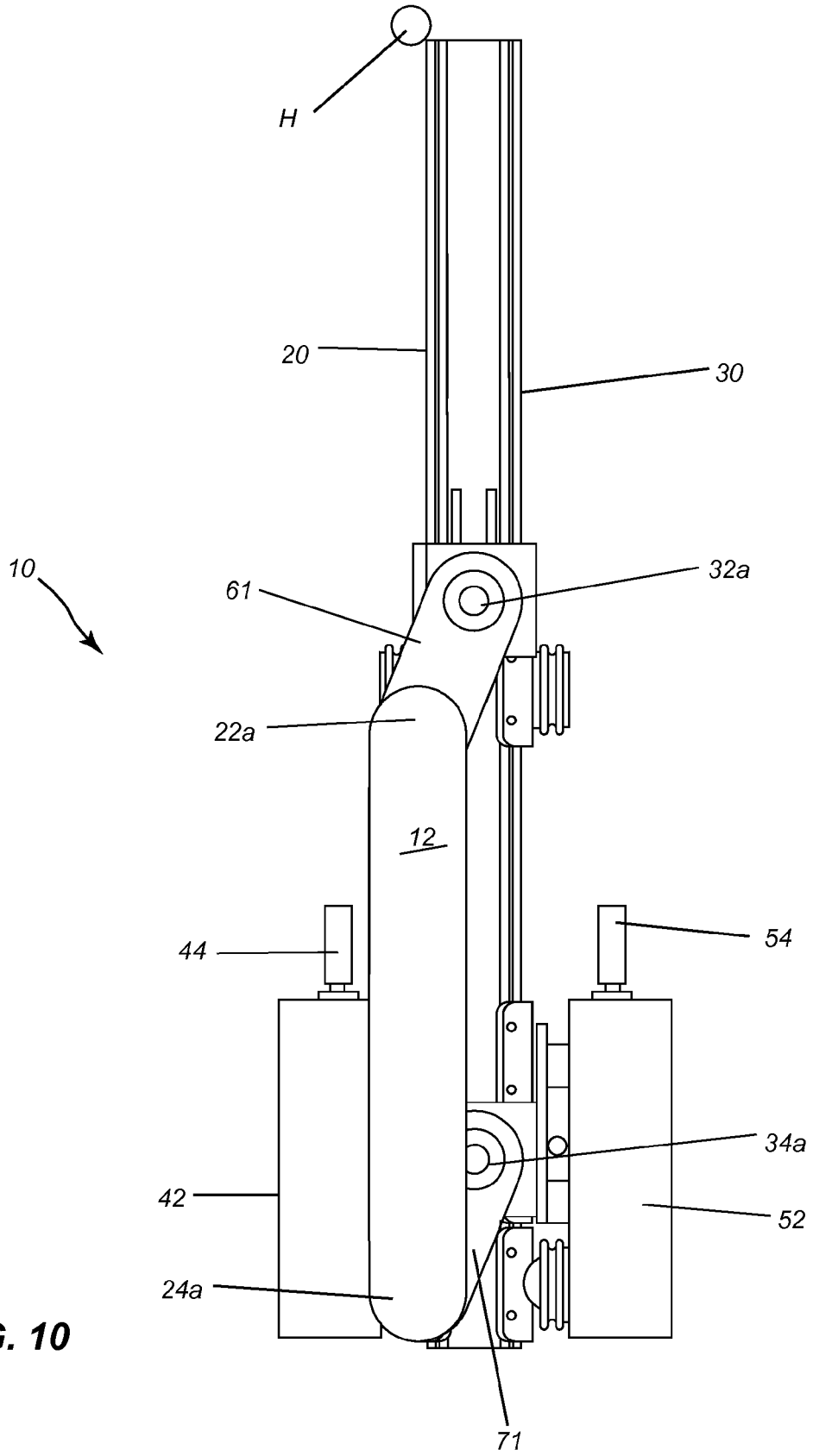
FIG. 10 is a bottom view of the rotary mechanism of FIG. 7 as the drill feed rail continues to swing from the drilling position toward the bolting position.
Figure 11:
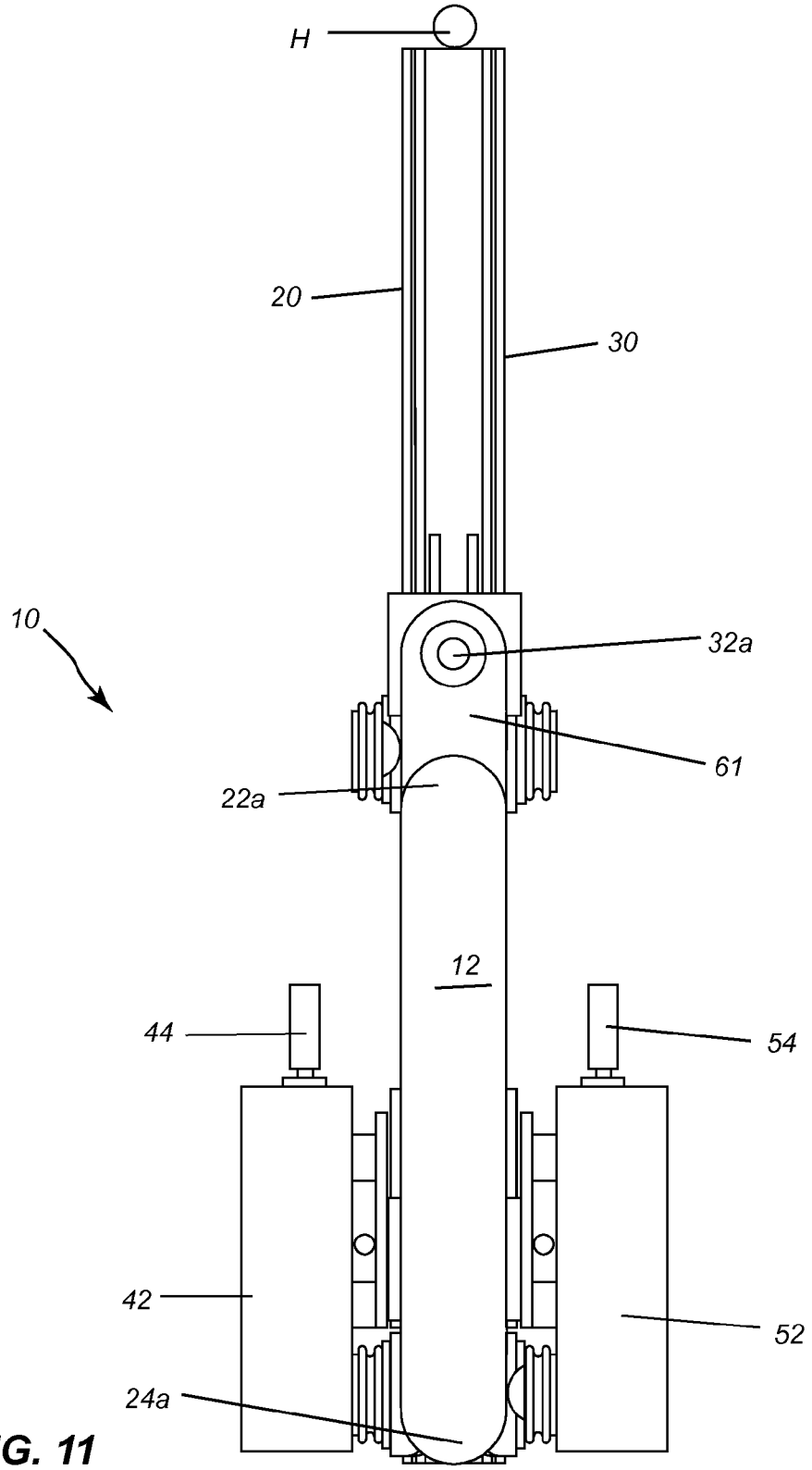
FIG. 11 is a bottom view of the rotary mechanism of FIG. 7 as the drill feed rail reaches its intermediate posture midway between the drilling and bolting positions.
Figure 12:
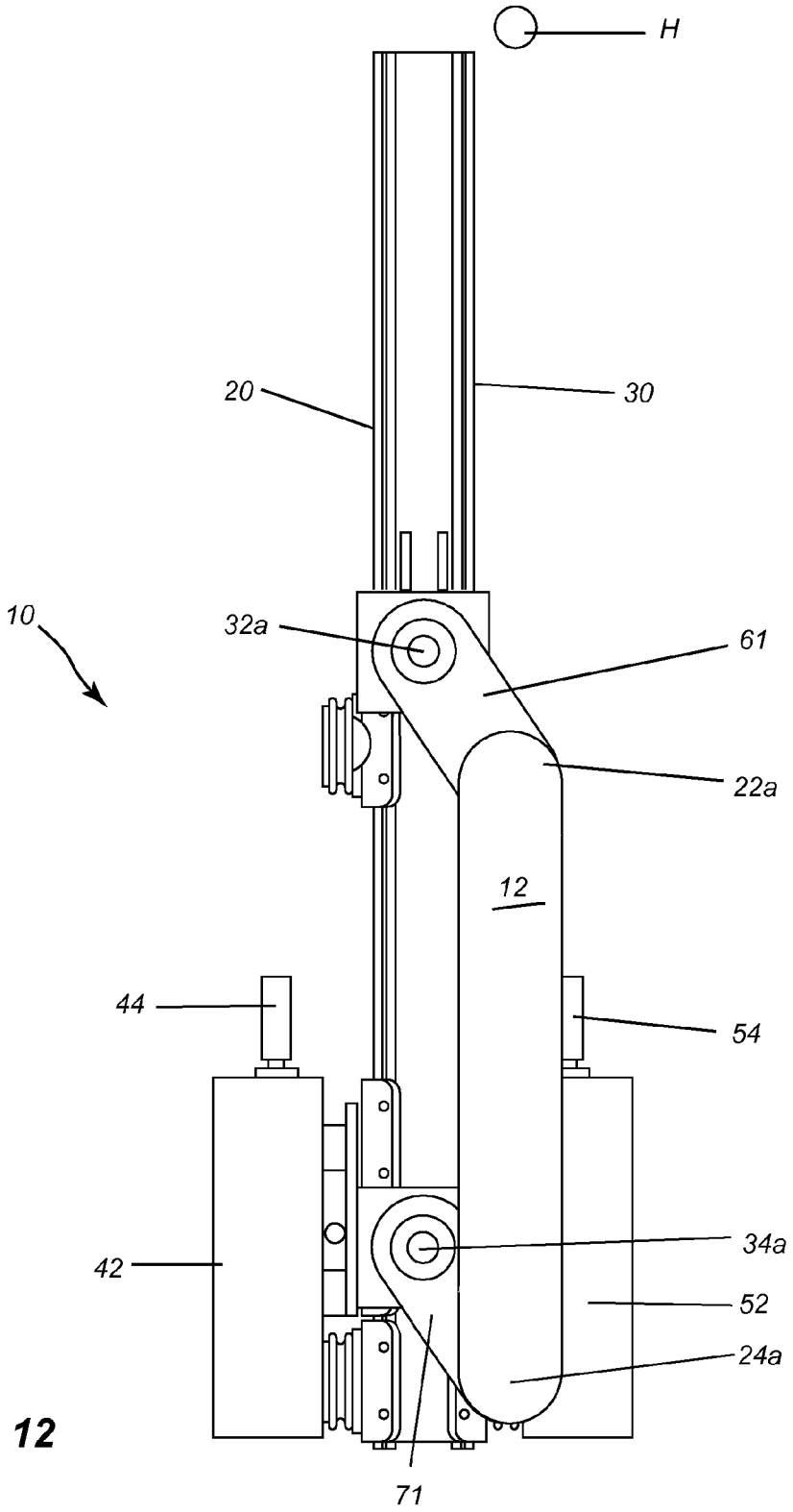
FIG. 12 is a bottom view of the rotary mechanism of FIG. 7 as the bolter feed rail rotates toward the bolting position.
Figure 13:
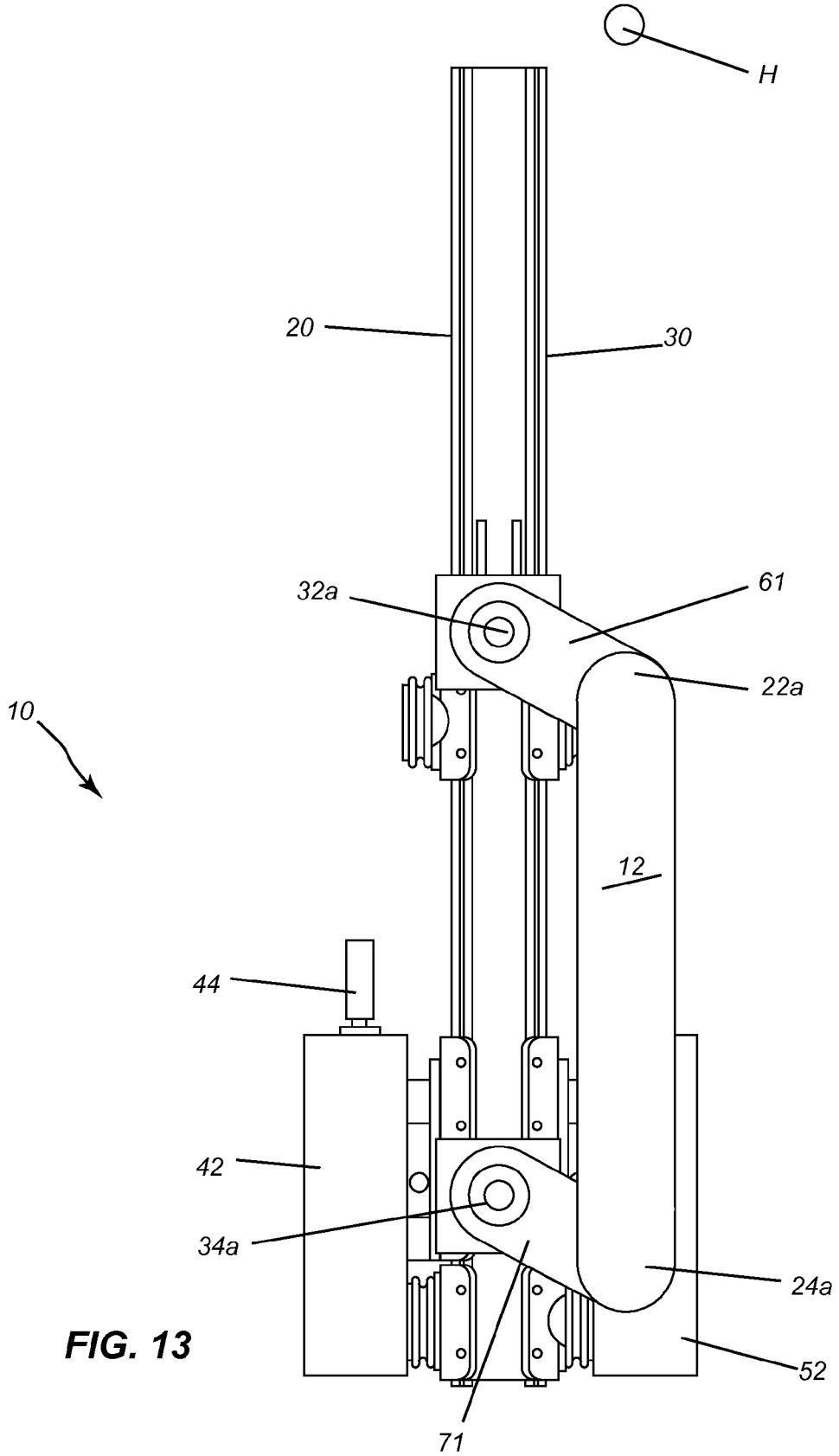
FIG. 13 is a bottom view of the rotary mechanism of FIG. 7 as the bolter feed rail has almost completed its rotation from the drilling position to the bolting position.
Figure 14:
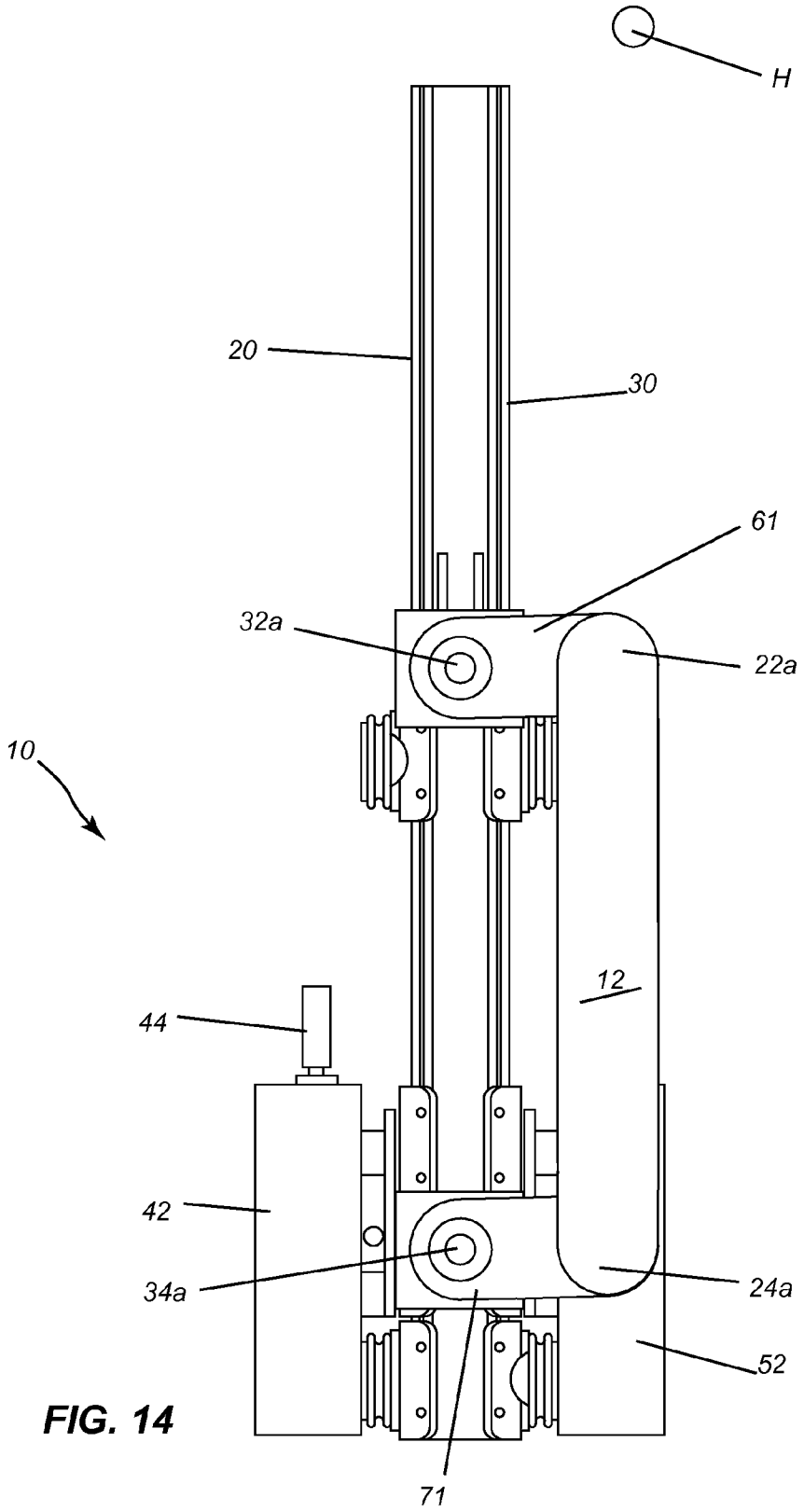
FIG. 14 is a bottom view of the rotary mechanism of FIG. 7 as the drill feed rail has reached the bolting position.

FIGS. 8-14 incrementally depict the rotation of the drill and bolter feed rails for the second embodiment of the system. In FIG. 8, the system is in the drilling position. In this position, the drill feed 42 advances on the drill feed rail 20 to drill a hole H in the rock. In FIG. 9, the back-to-back feed rails begin to rotate ("swing") from the drilling position toward the bolting position. FIG. 10 shows the back-to-back feed rails as they continue to rotate toward the bolting position. In FIG. 11, the system reaches its neutral position with the pivot arms 61, 71 and feed rails 20, 30 aligned with the frame 12. In this neutral position, as noted above, cement may be inserted into the hole H as a prelude to inserting the rock bolt into the hole H. In FIG. 12, the back-to-back feed rails continue to rotate toward the bolting position. In FIG. 13, the feed rails 20, 30 are shown almost in the bolting position. Finally, in FIG. 14, the back-to-back feed rails 20, 30 have reached the bolting position. In this position the bolter feed is well aligned with the drilled hole H. The bolter feed is then advanced to insert the rock bolt into the drilled hole H. Note that pivot arm 61 rotates substantially 180 degrees from one side to another side. Likewise, pivot arm 71 rotates substantially 180 degrees as well. To return to the drilling position the rotation is reversed. The rock bolter is then moved, re-oriented or repositioned relative to the rock face to drill and bolt a new hole. Drilling and bolting operations can thus proceed efficiently and accurately with this novel mechanism. The mechanism rotates or swings back and forth between drilling and bolting positions without loss of positional accuracy.

In both the first and second embodiments, the rotary mechanism is a parallelogram. In the first embodiment, the parallelogram is defined by points 22, 24, 32, 34. In the second embodiment, the parallelogram is defined by points 22*a*, 24*a*, 32*a*, 34*a*. In the first embodiment, the kinematics of this mechanism mean that the feed rails remain parallel while the pivot arms remain parallel to each other. In the second embodiment, the back-to-back feed rails remain parallel to the frame while the pivot arm remain parallel to each other. In each instance, the feed rails are rotationally coupled to rotate in unison between drilling and bolting positions.

Figure 15:
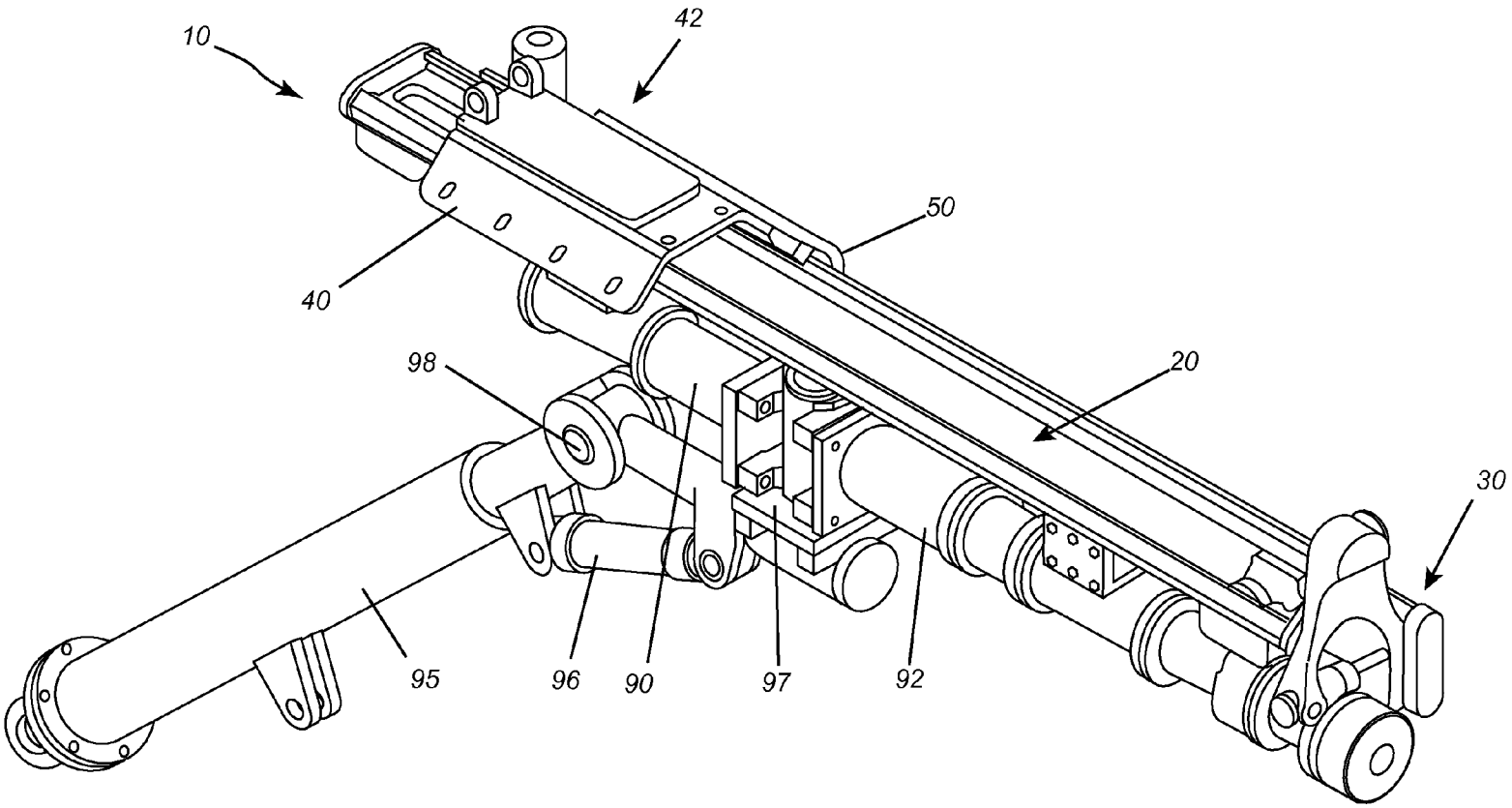
FIG. 15 is an isometric view of a rotary mechanism for concurrently rotating a drill feed rail and a bolter feed rail in accordance with a second embodiment of the present invention.

A second embodiment of the rock drilling and bolting system 10 is depicted by way of example in FIG. 15. The system 10 includes a drill feed rail 20 and a bolter feed rail 30. The drill feed rail 20 supports a movable (i.e. slidable) drill feed 42 on a drill feed carriage 40. The bolter feed rail 30 supports a movable (i.e. slidable) bolter feed on a bolter feed carriage 50. The drill feed rail and bolter feed are indexable (rotatable) about an axis of rotation. As illustrated, the system 10 includes a rotary mechanism having a first indexing rotary actuator 90 and a second indexing rotary actuator 92. The actuators 90, 92 are aligned with the axis of rotation. In other words, these inline actuators 90, rotate about the same axis of rotation. These inline actuators 90, 92 together provide the torque to index the drill feed and bolter feed. A positioning boom 95 is also shown in FIG. 15. The boom may be mounted to a vehicle (not shown). Pivotally connected to the boom is a hydraulic cylinder 96 for adjusting the pitch of the drill feed and bolter feed relative to the boom. The cylinder 96 pivotally connects to a frame 97 that is pivotally mounted to a rotating element 98. Extension of the cylinder 96 causes the frame 97 to pitch upwardly by rotating about the rotating element 98. Retraction of the cylinder 96 causes the frame 97 to rotate about the rotating element in the opposite direction, thereby causing the frame to pitch downwardly. The rotary actuators 90, 92 are each mounted on one side to the frame 97. The other side of each actuator is mounted to the drill feed rail and bolter feed rail. Actuation of the rotary actuators thus causes the drill feed rail and bolter feed rail to rotate (to be indexed). This rotary mechanism is an improved over comparable conventional designs (e.g. turret-type bolters) because it utilizes fewer parts, requires less maintenance, and is less expensive to manufacture.

Figure 16:
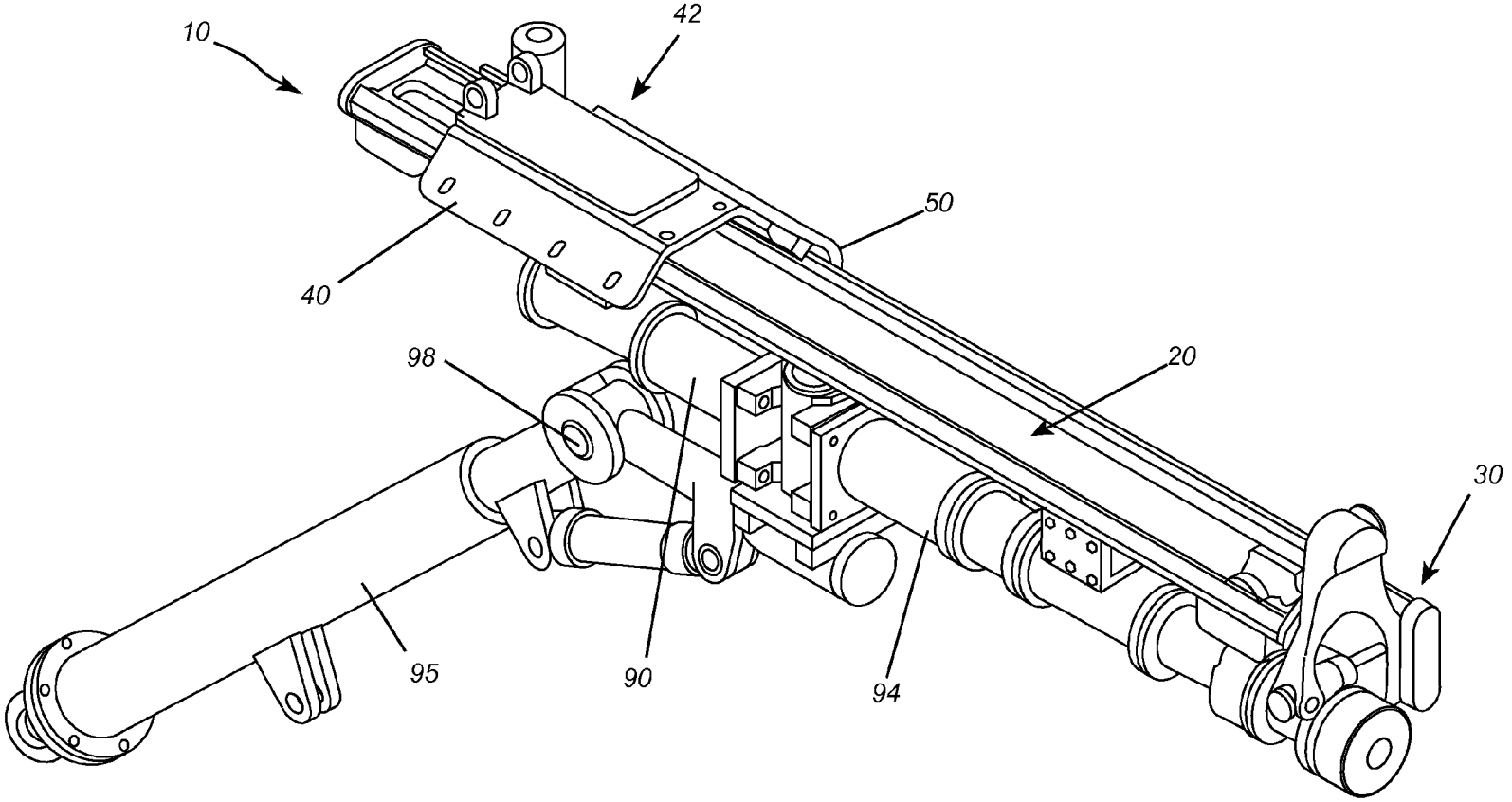
FIG. 16 is an isometric view depicting a variant of the mechanism of FIG. 15.
Figure 17:
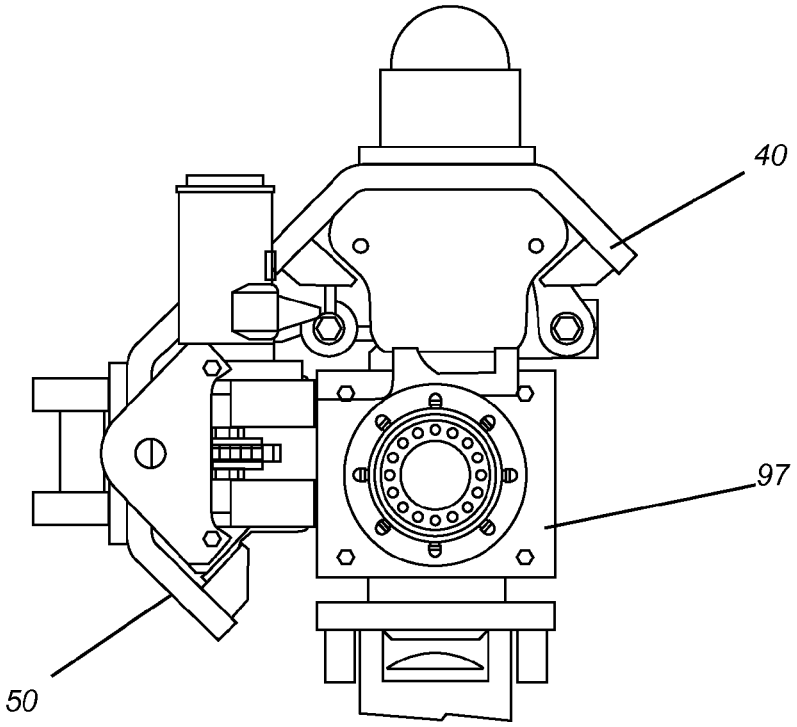
FIG. 17 is a rear view of the mechanism in an initial (drilling) position.
Figure 18:
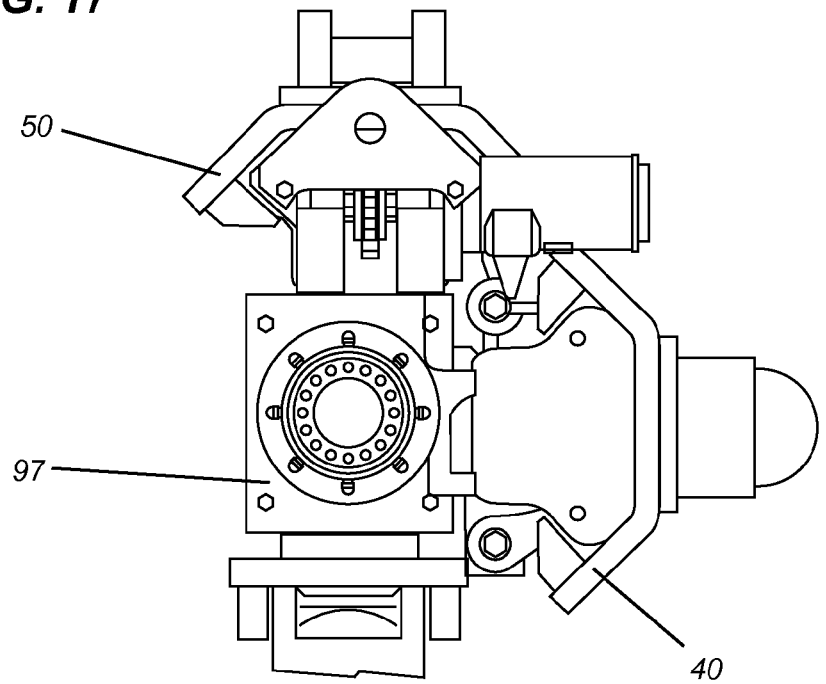
FIG. 18 is a rear view of the mechanism in a final (bolting) position.

A variant of the rotary mechanism is depicted by way of example in FIG. 16 in which a single indexing rotary actuator 90 provides the torque to index the drill feed and bolter feed. A rotation bearing 94 may be provided along the axis of rotation as shown in FIG. 16. This rotary mechanism enables the system to index from an initial (drilling) position as shown in FIG. 17 to a final (bolting) position as shown in FIG. 18.

The present invention has been described in terms of specific embodiments, examples, implementations and configurations which are intended to be exemplary or illustrative only. Other variants, modifications, refinements and applications of this innovative technology will become readily apparent to those of ordinary skill in the art who have had the benefit of reading this disclosure. Such variants, modifications, refinements and applications fall within the ambit and scope of the present invention. Accordingly, the scope of the exclusive right sought by the Applicant for the present invention is intended to be limited solely by the appended claims and their legal equivalents.

The invention claimed is:

1. A rock drilling and bolting system comprising:

a drill feed rail defining a first axis and having first and second pivot attachment points;

a bolter feed rail defining a second axis parallel to the first axis and having first and second pivot attachment points, the bolter feed rail being parallel to the drill feed rail;

a drill feed adapted to slide on the drill feed rail;

a bolter feed adapted to slide on the bolter feed rail;

a first L-shaped pivot arm pivotally connected to the first pivot attachment points of the drill feed rail and the bolter feed rail;

a second L-shaped pivot arm pivotally connected to the second pivot attachment points of the drill feed rail and the bolter feed rail;

a frame;

an actuator mounted to the frame for rotating the drill feed rail and the bolter feed rail;

wherein the bolter feed rail is rotationally coupled to the drill feed rail by the first and second pivot L-shaped pivot arms to enable the drill feed rail and the bolter feed rail to rotate in unison between a drilling position and a bolting position by rotating in a plane defined by the first axis and the second axis.

2. The system as claimed in claim 1 wherein the actuator is a hydraulic rotary actuator.

3. The system as claimed in claim 1 wherein the actuator is a hydraulic linear actuator.

4. A method of installing ground support using a rock drilling and bolting system having a drill feed rail and a bolter feed rail, the method comprising:

positioning a drill feed rail defining a first axis and being pivotally connected at two attachment points to a bolter feed rail by first and second L-shaped pivot arms, the bolter feed rail defining a second axis parallel to the first axis;

feeding a drill string using a drill feed slidable on the drill feed rail;

drilling a hole in the rock;

rotating the drill feed rail and the bolter feed rail in a plane defined by the first axis and the second axis using an actuator mounted to a frame to rotate the drill feed rail out of alignment with the hole and to concurrently rotate the bolter feed rail into alignment with the hole;

feeding a rock bolt using a bolter feed slidable on the bolter feed rail; and installing the rock bolt into the hole.

5. The method as claimed in claim 4 wherein rotating the drill feed rail and the bolter feed rail is accomplished using a hydraulic rotary actuator.

6. The method as claimed in claim 4 wherein rotating the drill feed rail and the bolter feed rail is accomplished using a hydraulic linear actuator.

7. A rock drilling and bolting system comprising:

a frame;

a drill feed rail mounted to the frame, the drill feed rail defining a first axis;

a bolter feed rail mounted to the frame in a back-to-back arrangement with the drill feed rail, the bolter feed rail defining a second axis;

a drill feed movably mounted on the drill feed rail;

a bolter feed movably mounted on the bolter feed rail;

a first pivot arm pivotally connected to the frame;

a second pivot arm pivotally connected to the frame; and an actuator connected between the first and second pivot arms for rotating the drill feed rail and the bolter feed rail in a plane defined by the first axis and the second axis from a drilling position to a bolting position that is aligned with a hole drilled in the drilling position.

8. The system as claimed in claim 7 wherein the actuator is a hydraulic rotary actuator.

9. The system as claimed in claim 7 wherein the actuator is a hydraulic linear actuator.

10. A method of installing ground support using a rock drilling and bolting system, the method comprising:

positioning a drill feed rail at a rock face, the drill feed rail defining a first axis and being attached via a frame in a back-to-back arrangement to a bolter feed rail defining a second axis parallel to the first axis;

feeding a drill string using a drill feed movably mounted to the drill feed rail;

drilling a hole in the rock face;

rotating the drill feed rail and the bolter feed rail in a plane defined by the first axis and the second axis using an actuator connected to first and second L-shaped pivot arms which are also pivotally connected to the frame to thereby rotate the bolter feed rail into alignment with the hole;

feeding a rock bolt using a bolter feed movably mounted to the bolter feed rail; and installing the rock bolt into the hole.

11. The method as claimed in claim 10 wherein rotating the drill feed rail and the bolter feed rail is accomplished using a hydraulic rotary actuator.

12. The method as claimed in claim 10 wherein rotating the drill feed rail and the bolter feed rail is accomplished using a hydraulic linear actuator.

13. A rock drilling and bolting system comprising:

a frame;

a drill feed rail rotationally supported on the frame, the drill feed rail defining a first axis and having a drill feed slidable on the drill feed rail;

a bolter feed rail rotationally supported on the frame, -the bolter feed rail defining a second axis parallel to the first axis and having a bolter feed slidable on the bolter feed rail;

a rotary mechanism comprising a first pivot arm and a parallel second pivot arm that rotationally couples the bolter feed rail to the drill feed rail;

an actuator mounted to the frame and the rotary mechanism for simultaneously rotating the drill feed rail and the bolter feed rail in a plane defined by the first axis and the second axis between a drilling position for drilling and a bolting position for bolting.

14. The system as claimed in claim 13 wherein the rotary mechanism comprises first and second L-shaped pivot arms connecting the drill feed rail and the bolter feed rail at respective pivot attachment points.

15. The system as claimed in claim 13 wherein the rotary mechanism comprises first and second straight-member pivot arms connecting to a frame supporting the drill feed rail and the bolter feed rail in a back-to-back arrangement.

* * * * *